United States Patent [19]
Dickerson
[11] 4,317,536
[45] Mar. 2, 1982

[54] TWO-PIECE CONTAINER

[75] Inventor: Robert B. Dickerson, Winston-Salem, N.C.

[73] Assignee: Container Corporation of America, Chicago, Ill.

[21] Appl. No.: 201,497

[22] Filed: Oct. 28, 1980

[51] Int. Cl.[3] ..... B65D 5/22; B65D 5/72; B65D 5/35; B65D 5/66

[52] U.S. Cl. ..... 229/34 R; 229/17 R; 229/23 R; 229/23 BT; 229/44 R

[58] Field of Search ..... 229/34 R, 34 HW, 23 BT, 229/44 R, 35, 17 R, 17 B, 7 R, 17 SC, 9, 11, 43, 30, 31 R, 31 FS, 32, 38, 45 R; 220/73; 206/63

[56] References Cited

U.S. PATENT DOCUMENTS

| | | | |
|---|---|---|---|
| 340,904 | 4/1886 | Auchter lonie | 229/17 B |
| 1,865,608 | 7/1932 | Andrews | 229/11 |
| 2,042,799 | 6/1936 | Ort | 229/17 R |
| 2,727,675 | 12/1955 | Mairs et al. | 229/30 |
| 2,779,526 | 1/1957 | Vogt | 229/34 R |
| 2,917,219 | 12/1959 | Schimel | 229/23 R |
| 3,122,299 | 2/1964 | Haas | 229/34 HW |
| 3,202,336 | 8/1965 | Bord | 229/17 SC |
| 3,286,901 | 11/1966 | Anderson | 229/23 BT |
| 3,321,077 | 5/1967 | Paige | 229/39 B |
| 3,616,989 | 11/1971 | Martmek | 229/43 |
| 3,645,437 | 2/1972 | Giebel et al. | 229/44 R |
| 3,826,420 | 7/1974 | Bamburg et al. | 229/45 |
| 3,887,126 | 6/1975 | Wilson | 229/34 R |
| 4,133,430 | 1/1979 | Cravens | 229/43 |
| 4,168,028 | 9/1979 | McCall | 229/34 R |

*Primary Examiner*—Stephen Marcus
*Assistant Examiner*—Gary E. Elkins
*Attorney, Agent, or Firm*—Richard W. Carpenter; Davis Chin

[57] ABSTRACT

A two-piece container comprising a body member and a cover member, the cover member including cover locking flaps having recessed portions for interlocking engagement with cover end flaps to maintain the container in the closed position. The end wall panels of the body member and cover member are easily openable at either end for dispensing the contents from the container.

4 Claims, 6 Drawing Figures

TWO-PIECE CONTAINER

BACKGROUND OF THE INVENTION

1. Field of the Invention

This invention relates generally to containers and more particularly, to a two-piece container having interlocked body and cover members, the containers being stackable onto a shelf and can be opened at either end in the stacked position for dispensing the contents within the container.

2. Description of the Prior Art

A state of the art search directed to the subject matter of this application uncovered the following patents:

U.S. Pat. Nos. 2,779,526; 2,917,219; 3,122,299; 3,286,901; 3,616,989 and 3,645,437.

None of the prior art uncovered in the search disclosed a two-piece container having body member and a cover member like that of the present invention which provides interlocking cover means. This is accomplished by cover locking flaps on the cover member which are formed with recessed portions for interlocking engagement with cover end flaps to maintain the container in the closed position.

SUMMARY OF THE INVENTION

An object of the present invention is to provide a new and improved two-piece container which can be stacked onto a shelf and can be opened at either end in the stacked position for dispensing the contents within the container.

It is another object of the present invention to provide a two-piece container having body and cover members which are each formed from a separate one-piece blank of material that is cut, scored and foldable for easy set-up by hand into the completed container and may be easily knocked down to be in the flat or unfolded condition for storage and later reuse.

It is another object of the present invention to provide a two-piece container consisting of a body member and a cover member, the cover member being formed with cover locking flaps having recessed portions for interlocking engagement with cover end flaps to maintain the container in the closed position.

In accordance with these aims and objectives, the instant invention is concerned with the provision of a two-piece container which includes a body member and a cover member. The body member consists of a bottom panel, end wall panels, a pair of end body flaps, outer side wall panels and inner side wall panels which are all suitably folded for erection. The cover member consists of a top panel, side wall panels, a pair of cover end flaps, end wall panels and a pair of cover locking flaps which are all suitably folded and telescopable over the body member to form the completed container. The cover locking flaps are provided with recessed portions for interlocking engagement with the cover end flaps to maintain the container in the closed position. Each of the cover end wall panels and locking flaps is pivotable upwardly relative to the fold line connecting the cover end wall panels to the top panel, and each of the body end wall panels and related side flaps is pivotable downwardly relative to the fold line connecting the body end wall panels to the bottom panel when the container is opened for dispensing.

The instant invention is particularly efficient and economical in providing a new and improved two-piece container since the structure can be formed relatively easy without the need of taping, gluing and the like. Further, the interior of the container in the present invention is easily accessible from either end thereof in the stacked or unstacked position.

BRIEF DESCRIPTION OF THE DRAWINGS

These and other objects and advantages of the present invention will become more fully apparent from the following detailed description when read in conjunction with the accompanying drawings wherein.

DESCRIPTION OF THE PREFERRED EMBODIMENT

Figure 1:
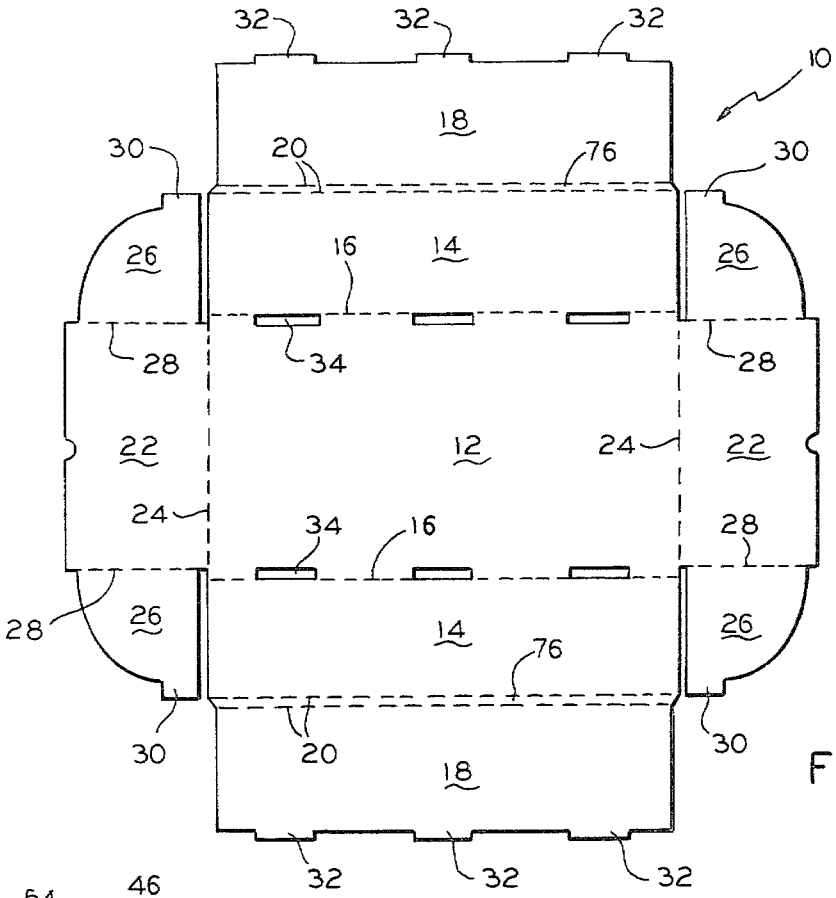
FIG. 1 is a plan view of the blank for the container body member constructed according to the principles of the present invention.

Referring now in detail to the drawings, there is shown in FIG. 1 a blank designated generally by reference numeral 10 from which a container body member 11 of the present invention may be formed. The blank 10 comprises a bottom panel 12 to which outer side wall panels 14 are attached along fold lines 16. Inner side wall panels 18 are secured to each of the outer side wall panels 14 along double fold lines 20 which define a narrow connecting panel 76 therebetween. End wall panels 22 are attached to the bottom panel 12 along fold lines 24. Body side flaps 26 are hingedly joined along fold lines 28 to opposed side edges of the end wall panels 22. Each of the end body flaps 26 is formed with an integral projection tab 30, the operation of which will be explained more fully hereinafter. The free edges of the inner side wall panels 18 are provided with a plurality of projections 32. Each of the projections 32 is adapted to interlock within one of a plurality of slots 34 formed in the bottom panel 12 along the fold lines 16 when the blank 10 is set up so as to maintain the outer and inner side wall panels 14, 18 in the erected position.

Figure 2:
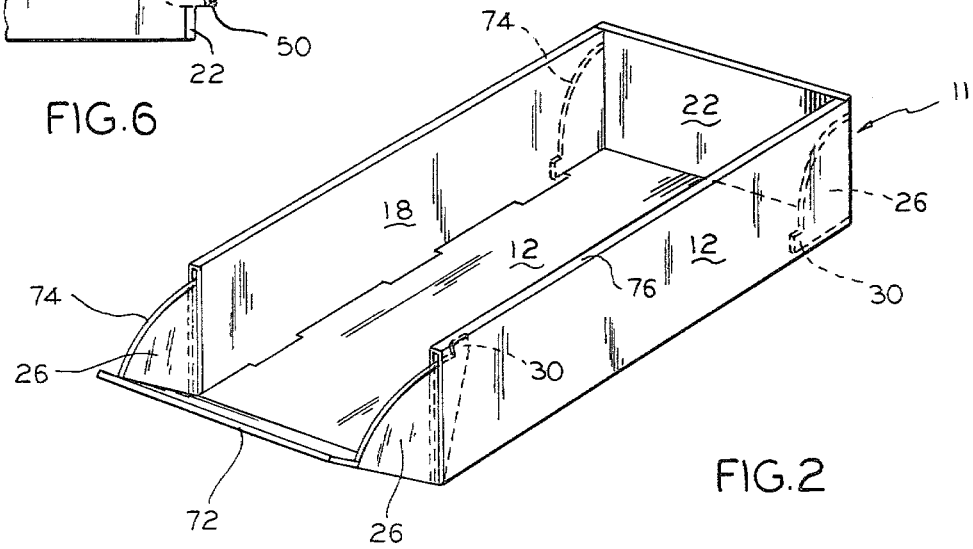
FIG. 2 is a perspective view of the body member of the present invention showing one end wall panel and related body side flaps pivoted outwardly in the open position.
Figure 4:
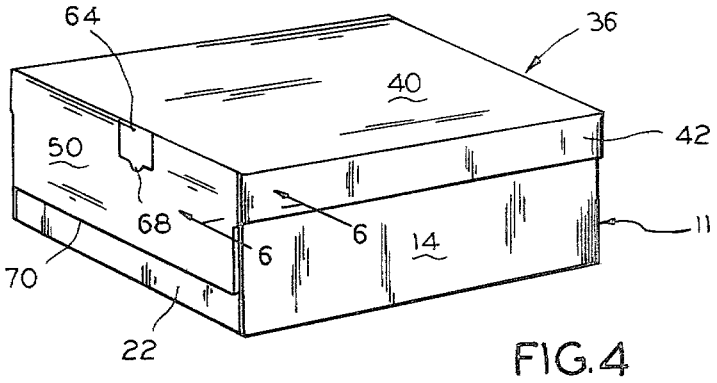
FIG. 4 is a perspective view of the two-piece container of the present invention showing the cover locking cover flaps positioned between the body side flaps and the outer side wall panels of the body member in fully assembled position.

To erect the container body member 11 in FIG. 4, the end wall panels 22 are folded up perpendicularly about the fold lines 24, and the body side flaps 26 are folded inwardly at right angles to the respective end wall panels 22 along the fold lines 28. In this position, the outer side wall panels 14 are folded upwardly at right angles to the bottom panel 12 about the fold lines 16. The inner side wall panels 18 are folded downwardly and inwardly so that the outer side wall panels 14 assume a spaced apart parallel relationship to the inner side wall panels 18 as shown in FIG. 2. It will be noted that the projections 32 interlock in the respective slots 34 and the body side flaps 26 are disposed between the outer and inner side wall panels 14 and 18. At this point, the container body member is now ready for easy loading from the top with its contents such as shirts, sweaters or other similar garments prior to telescoping engagement with the cover member. In this finished stage, the bottom panel, the inner and outer side wall panels, the end wall panels and the body side flaps are all held together without the need of taping, gluing and the like.

Figure 3:
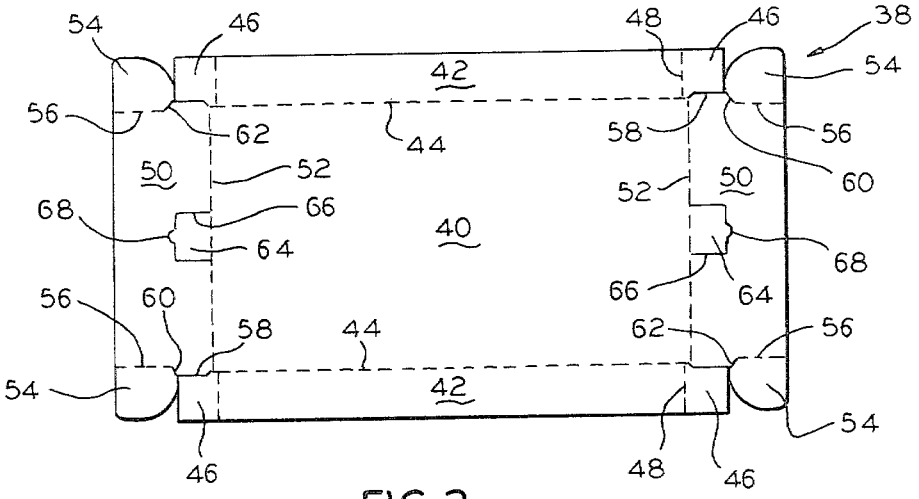
FIG. 3 is a plan view of the blank for the container cover member constructed according to the principles of the present invention.

A cover member 36 of the present invention is constructed from a blank designated generally by reference numeral 38 shown in FIG. 3. The cover member 36 comprises a top panel 40 to which side wall panels 42 are attached along fold lines 44. Cover end flaps 46 are hingedly joined to opposed edges of the side wall panels 42 along fold lines 48. End wall panels 50 are attached to the top panel 40 along fold lines 52. Cover locking flaps 54 are hingedly joined to opposed edges of the end wall panels 50 along fold lines 56. The cover end flaps are separated from the end wall panels 50 by cut lines 58. Each of the cover locking flaps 54 is provided with a recessed portion 60 formed by an arcuate cut line 62. It should be noted that the fold lines 56 are disposed substantially parallel to and spaced inwardly from the cut lines 58 so that the cut lines 62 are provided therebetween. For ease of opening, hinged tabs 64 defined by cut lines 66 and recesses 68 are formed in the end wall panels 50.

Figure 6:
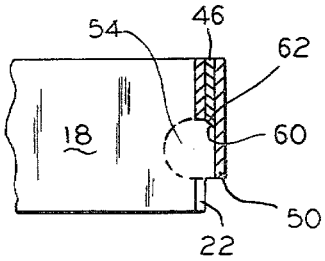
FIG. 6 is a section view taken along the lines 6—6 of FIG. 4.

To erect the cover member 36 in FIG. 4, the side wall panels 42 are folded up perpendicularly about the fold lines 44, and the cover end flaps 46 are folded inwardly at right angles to the respective side wall panels 42 along the fold lines 48. At this point, the cover member 36 can be made to telescope over the body member 11 so that the open area defined by the cover side wall panels 42 and end flaps 46 will enclose and lie opposite the open area defined by the outer side wall panels 14 and the end wall panels 22 of the body member 11. Next, the end wall panels 50 are moved pivotally and downwardly relative to the fold lines 52. As the end wall panels 50 are pivoted, the cover locking flaps 54 are folded downwardly at right angles along the fold lines 56 so that the flaps 54 can be inserted in frictional engagement between the outer side walls panels 14 and the body side flaps 26 of the body member 11 to assume the completed position shown in FIG. 4. The cover end flaps 46 are sandwiched between the cover and body member end wall panels 50, 22. In this fully assembled position, the recessed portions 60 of the cover locking flaps 54 will be held in a frictional interlocking engagement with the lower edges of the cover end flaps 46 along the arcuate cut lines 62 so as to maintain the cover member 36 down and in place on the body member 11, as best seen in FIG. 6.

Figure 5:
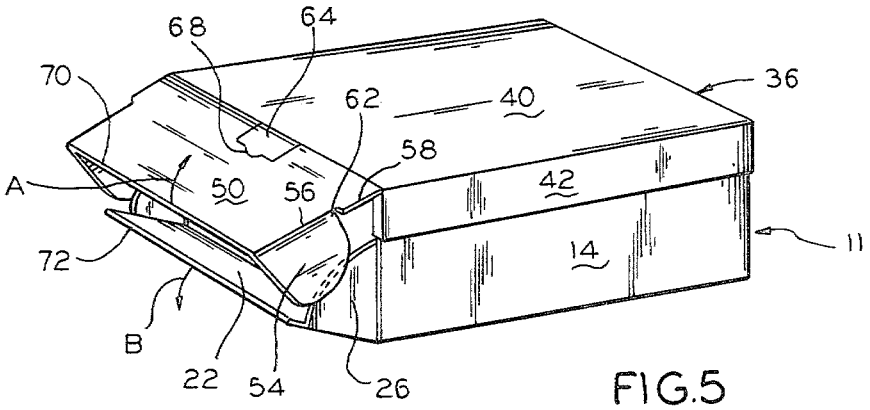
FIG. 5 is a perspective view of the two-piece container showing the end wall panels of the cover member and the body member in the partially opened position.

When it is desired to dispense the contents from one of the ends of the two-piece container, it is initially necessary to grasp an edge 70 of the cover end wall panel 50 and swing the same outwardly and upwardly in the direction of the arrow A thereby disengaging the flaps 54 disposed between the outer side wall panel 14 and the body side flap 26. Alternatively, fingers of a user could be inserted into the recess 68 for swinging outwardly the end wall panel 50. Next, the cover member 36 is lifted open by causing the top panel 40 to pivot about the fold line 52 connecting the other end wall panel to the top panel. At this point, edge 72 of the body end wall panel 22 can be pulled outwardly and downwardly in the direction of the arrow B to the open position as illustrated in FIG. 5. It will be noted that the body side flaps 26 are provided with edges 74 of a rounded shape for moving in and out of the area between the outer and inner side wall panels 14, 18 so as to close and open the container body member 11. In order to limit the outward pivotal movement of the flaps 26, the tabs 30 engage lockingly against the underneath side of connecting panels 76 defined between the fold lines 20. After dispensing, the body end wall panel 22 together with the body side flaps 26 and the cover end wall panel 50 together with the cover locking flaps 54 are moved back into its normal position as described earlier to close the two-piece container.

From the foregoing detailed description, it can be thus seen that the present invention provides a new and improved two-piece container which permits ready access to its interior at either end in the stacked or unstacked position. Further, cover locking flaps having recessed portions are provided for interlocking engagement with the cover end flaps to maintain the container in closed position.

While there has been illustrated and described what is at present to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out this invention, but that the invention will include all embodiments falling within the scope of the appended claims.

What is claimed:

1. A two-piece container having telescoping body and cover member each formed from a separate one-piece blank of foldable material which is cut and scored, comprising in combination:

(a) said body member including a bottom panel and end and outer side wall panels connected along fold lines to opposed end and side edges of said bottom panel and extending up at right angles thereto;

(b) inner side wall panels connected along fold lines to upper edges of said outer side wall panels and extending downwardly therefrom in a spaced apart parallel relationship therewith;

(c) a pair of body side flaps hingedly attached to opposed side edges of said end wall panels and extending inwardly therefrom between said body inner and outer side wall panels;

(d) said cover member including a top panel and end and side wall panels connected along fold lines to opposed end and side edges of said top panel and extending downwardly at right angles thereto;

(e) a pair of cover end flaps hingedly attached to opposed side edges of said cover side wall panels and extending inwardly therefrom between said cover and body member end wall panels when said cover member is in the closed position;

(f) a pair of cover locking flaps connected to opposed side edges of said cover end wall panels and extending inwardly therefrom between said body side flaps and outer side wall panels;

(g) each of said cover end wall panels and locking flaps being pivotable upwardly relative to the fold line connecting said cover end wall panels to said top panel and each of said body end wall panels and related side flaps being pivotable downwardly relative to the fold line connecting said body end wall panels to said bottom panel when the container is opened for dispensing; and (h) said cover locking flaps having recessed portions for interlocking engagement with said cover end flaps to maintain the container in the closed position.

2. A two-piece container as claimed in claim 1, wherein the free edges of inner side wall panels are provided with a plurality of projections for interlocking within a plurality of slots formed in said bottom panel to maintain said body member in the erect position.

3. A two-piece container as claimed in claim 1, wherein said body side flaps include tabs engageable with body side wall connecting panels for limiting the outward movement thereof when it is opened for dispensing.

4. A two-piece container as claimed in claim 1, wherein said cover end wall panels are provided with recesses and tabs to facilitate opening and lifting of said cover member.

* * * * *